US008322789B2

(12) United States Patent
Mendes et al.

(10) Patent No.: US 8,322,789 B2
(45) Date of Patent: Dec. 4, 2012

(54) TOY BAR MOUNTING ASSEMBLY, AND ASSOCIATED APPARATUS

(75) Inventors: Mark Mendes, Loganville, GA (US); Charles Simons, Alpharetta, GA (US)

(73) Assignee: Kids II, Inc., Alpharetta, GA (US)

( * ) Notice: Subject to any disclaimer, the term of this patent is extended or adjusted under 35 U.S.C. 154(b) by 289 days.

(21) Appl. No.: 12/796,058

(22) Filed: Jun. 8, 2010

(65) Prior Publication Data

US 2011/0037298 A1 Feb. 17, 2011

Related U.S. Application Data

(60) Provisional application No. 61/234,461, filed on Aug. 17, 2009.

(51) Int. Cl.
*A47D 13/10* (2006.01)
*A63H 33/00* (2006.01)

(52) U.S. Cl. ..... 297/274; 297/184.13; 446/227

(58) Field of Classification Search ..... 297/184.13, 297/274; 472/118, 119; 446/227
See application file for complete search history.

(56) References Cited

U.S. PATENT DOCUMENTS

| | | | | |
|---|---|---|---|---|
| 5,092,549 | A | 3/1992 | Beech | |
| 5,187,826 | A | 2/1993 | Mariol | |
| 5,758,889 | A * | 6/1998 | Ledakis | 297/184.13 X |
| 6,592,425 | B2 * | 7/2003 | Bapst et al. | 446/227 |
| 6,705,950 | B2 * | 3/2004 | Wood et al. | 446/227 X |
| 6,764,133 | B2 * | 7/2004 | Osato | 297/184.13 X |
| 7,963,896 | B2 * | 6/2011 | Nanna et al. | 482/142 |
| 2004/0198513 | A1 * | 10/2004 | Wood et al. | 472/118 |
| 2004/0198515 | A1 * | 10/2004 | Wood et al. | 472/118 |
| 2007/0224909 | A1 | 9/2007 | Schoenfelder et al. | |
| 2010/0163088 | A1 * | 7/2010 | Zeng | 297/184.13 X |

FOREIGN PATENT DOCUMENTS

CN 201 271 026 7/2009

* cited by examiner

*Primary Examiner* — Rodney B White
(74) *Attorney, Agent, or Firm* — Womble Carlyle Sandridge & Rice, LLP

(57) ABSTRACT

A mounting assembly for mounting a toy bar arrangement to a frame of an infant seat assembly is provided. The assembly includes a mounting member adapted to fixedly engage the frame. The assembly further includes a receptacle member operably engaged with the mounting member and defining a cavity. The receptacle member is rotatable about a substantially horizontal axis with respect to the mounting member, and between a locked position and an unlocked position in relation to a locking member associated with the mounting member. The assembly further includes a mating member adapted to operably engage a toy bar arrangement and configured to be removably received within the cavity of the receptacle member so as to be rotatable in conjunction with the receptacle member between the locked and unlocked positions. The mating member has a locking flange configured to engage the locking member in the locked position.

12 Claims, 12 Drawing Sheets

TOY BAR MOUNTING ASSEMBLY, AND ASSOCIATED APPARATUS

CROSS-REFERENCE TO RELATED APPLICATION

This application claims the benefit of U.S. Provisional Patent Application Ser. No. 61/234,461 filed Aug. 17, 2009, the entirety of which is incorporated herein by reference.

BACKGROUND OF THE DISCLOSURE

1. Field of the Invention

The present invention relates to infant seat products and, more particularly, to an assembly for mounting a toy bar arrangement to an infant seat assembly, and an associated apparatus.

2. Description of Related Art

There are several commercially-available variants of infant seats or so-called "bouncers." A bouncer usually consists of a frame and a seat which is supported by said frame and, additionally, may include features that are intended to entertain or soothe the infant occupant. Such features may include, for example, electromechanical vibration units, toys and toy bars intended to engage the interest of the infant occupant.

One commonly used feature is a toy bar. The toy bar attaches to the bouncer and provides a structure to which one may attach toys and/or other devices intended to capture the attention of and to engage the infant occupant. These toys may include electrical or mechanical features and may be permanently or semi-permanently attached to the toy bar or otherwise integral with the toy bar. The mounting devices which permit attachment of the toy bar to the frame are often designed to articulate in such a way as to facilitate use by the occupant (improving visibility or reach) or to allow the caregiver improved access to the occupant while being placed into or being removed from the bouncer.

A concern arising from the use of the toy bar is that it can appear to be, and may in fact be, used as a handle with which to lift the bouncer while occupied by an infant. This becomes a safety concern when the toy bar, while indeed appearing to be a handle, is not designed for use as a handle and, therefore, does not provide a safe means of transporting the bouncer while occupied. In such instances, the toy bar could potentially disengage from the frame/bouncer, or may not sufficiently balance and secure the seat so as to prevent the seat from inversion and possible discharge of the occupant.

Furthermore, previous designs of toy bars may demonstrate a variety of connection styles and geometry. While these designs are typically functional and relatively safe, both criteria are not typically met with equal success. For example, in strengthening a toy bar so that it does not disengage easily from the frame, such toy bars do not compensate for their potential use as a handle, to the extent that a caregiver might mistakenly assume it is designed for that purpose.

As such, it would be desirable to provide a device and associated apparatus capable of reducing instances of misuse of a toy bar as a handle during transportation of the bouncer, while also being capable of maintaining the toy bar in an engaged position during use thereof by the infant occupant.

BRIEF SUMMARY OF THE INVENTION

The above and other needs are met by the present invention which, according to one aspect, provides a mounting assembly for mounting a toy bar arrangement to a frame of an infant seat assembly. The mounting assembly comprises a mounting member adapted to fixedly engage a frame of an infant seat assembly. The mounting assembly further comprises a receptacle member operably engaged with the mounting member and defining a cavity. The receptacle member is rotatable about a substantially horizontal axis with respect to the mounting member, and between a locked position and an unlocked position in relation to a locking member associated with the mounting member. The mounting assembly further comprises a mating member adapted to operably engage a toy bar arrangement and configured to be removably received within the cavity of the receptacle member so as to be rotatable in conjunction with the receptacle member between the locked and unlocked positions. The mating member and the receptacle member engaged therewith extend along a non-vertical axis in the locked position. The mating member has a locking flange associated therewith. The locking flange is configured to engage the locking member in the locked position so as to prevent the mating member from disengaging the receptacle member in response to one of an axial force applied to the mating member along the non-vertical axis and a rotational force applied to the mating member toward the locked position. The mating member is configured to rotate to the unlocked position, and the locking member is configured to disengage the locking flange in the unlocked position so as to allow the mating member to be disengaged from the receptacle member, in response to at least one of an axial force applied to the mating member along a vertical axis and a rotational force applied to the mating member toward the unlocked position, so as to prevent the toy bar arrangement from supporting the frame of the seat assembly.

Another aspect of the present invention provides an infant seat assembly comprising a frame having first and second side portions, and a toy bar arrangement extending between the first and second side portions and having opposing ends. The infant seat assembly further comprises a pair of mounting members, each mounting member being fixedly engaged with one of the side portions of the frame. The infant seat assembly further comprises a pair of receptacle members, each receptacle member being operably engaged with a respective mounting member and defining a cavity. Each receptacle member is rotatable about a substantially horizontal axis with respect to the respective mounting member, and between a locked position and an unlocked position in relation to a locking member associated with at least one of the mounting members. The infant seat assembly further comprises a pair of mating members, each mating member being operably engaged with a respective end of the toy bar arrangement and being configured to be removably received within the cavity of the respective receptacle member so as to be rotatable in conjunction with the respective receptacle member between the locked and unlocked positions. Each mating member and the receptacle member correspondingly engaged therewith extends along a non-vertical axis in the locked position. The mating member received by the receptacle member associated with the at least one of the mounting members having the locking member associated therewith further includes a locking flange associated therewith. The locking flange is configured to engage the locking member in the locked position so as to prevent the mating member from disengaging the receptacle member in response to one of an axial force applied to the mating member via the toy bar arrangement along the non-vertical axis and a rotational force applied to the mating member via the toy bar arrangement toward the locked position. The mating member is configured to rotate to the unlocked position, and the locking member is configured to disengage the locking flange in the unlocked position so as to allow the mating member to be disengaged from the receptacle member, in response to at least one of an axial force applied to the mating member via the toy bar arrangement along a vertical axis and a rotational force applied to the mating member via the toy bar arrangement toward the unlocked position, so as to prevent the toy bar arrangement from supporting the frame of the seat assembly.

Embodiments of the present invention thus provide advantages as otherwise detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 16:
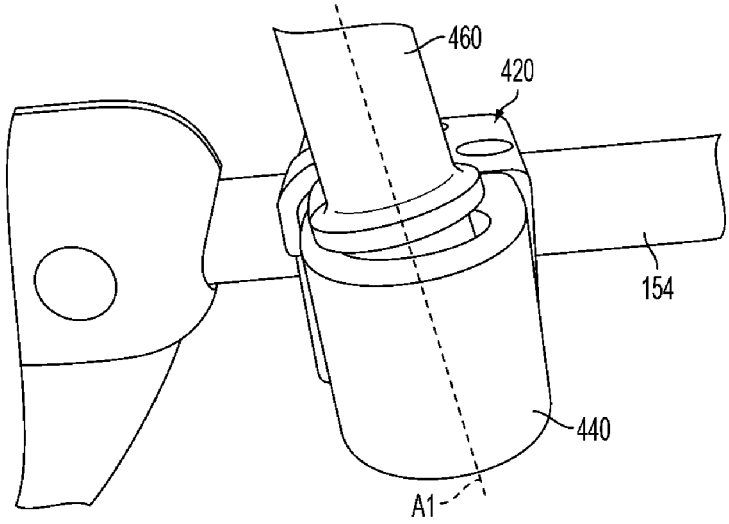
FIGS. 16 and 17 are perspective side views of a toy bar mounting assembly engaged with a seat frame of an infant seat assembly, illustrating the toy bar mounting assembly in a locked and unlocked position, respectively.
Figure 17:
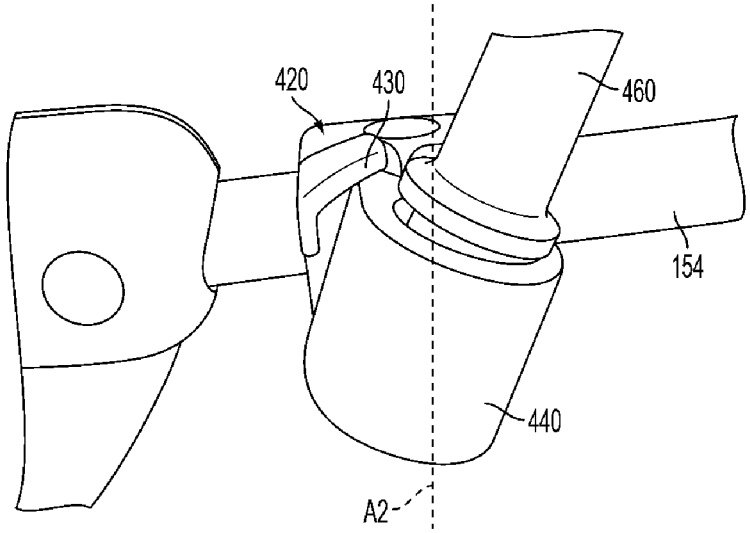
Figure 18:
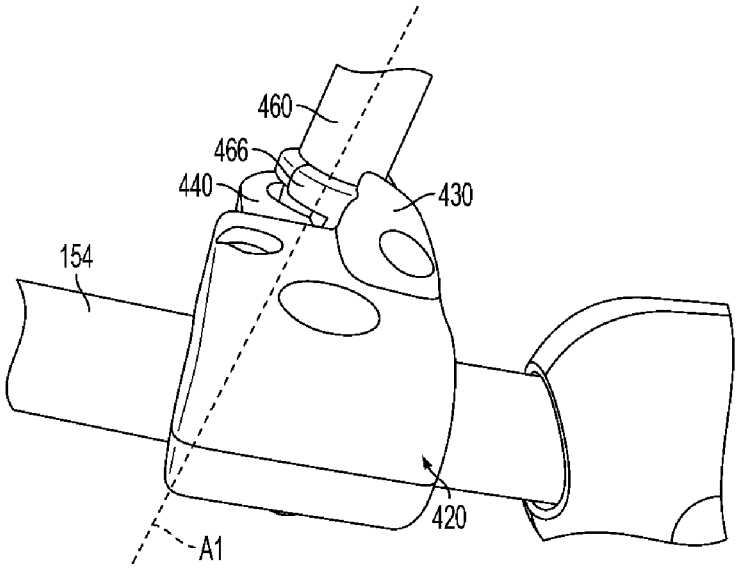
Figure 19:
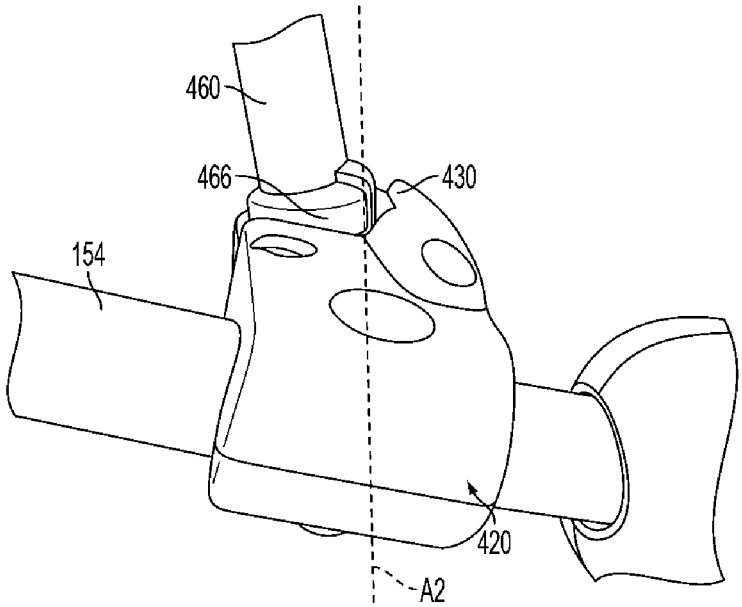
Figure 20:
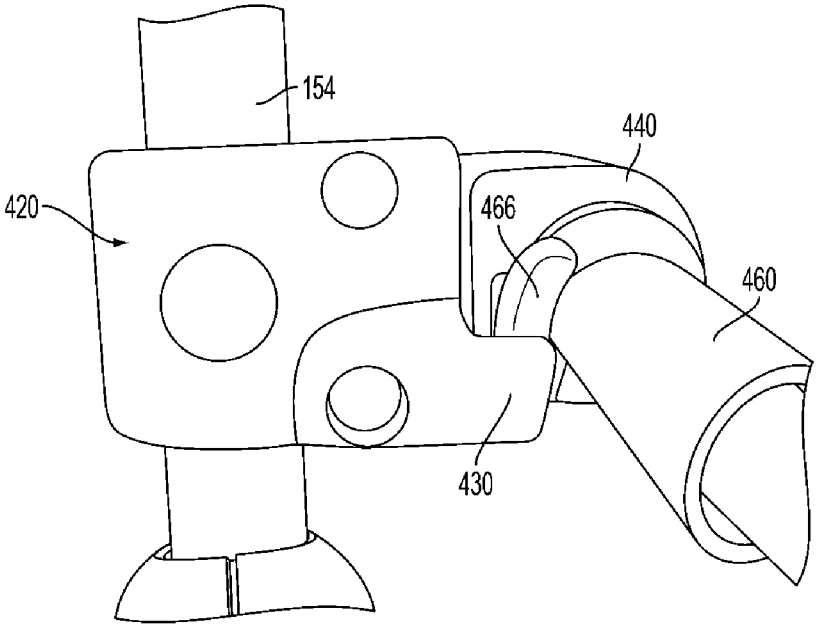
Figure 21:
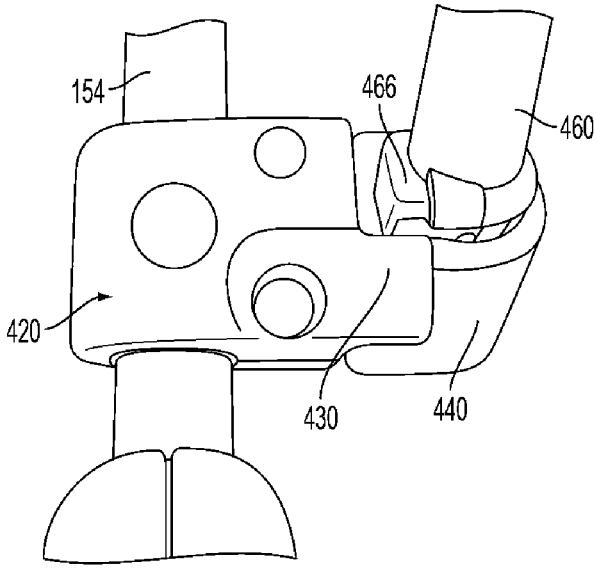

FIGS. 18 and 19 are perspective side views opposite of those shown in FIGS. 16 and 17, illustrating the toy bar mounting assembly in a locked and unlocked position, respectively; and FIGS. 20 and 21 are perspective top views of a toy bar mounting assembly engaged with a seat frame of an infant seat assembly, illustrating the toy bar mounting assembly in a locked and unlocked position, respectively.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Embodiments of the present invention address concerns in which a toy bar is mounted to a seat frame of an infant bouncer, as previously described. In this regard, embodiments of the present invention permit the toy bar to travel along an arcuate path, the extremes of which provide for one of two orientations, an "in-use" or locked position or an unlocked position which allows for ready disengagement or removal of the toy bar by a caregiver. To overcome the use of a toy bar as a handle, embodiments of the present invention provide a rotating toy bar mount assembly, configured such that when the toy bar is grasped (as when attempting to use it as a handle), it automatically releases from its mounts (and hence the frame of the bouncer) when lifted. However, when the toy bar is secured in the "in use" or locked position, it is locked so as to prevent the toy bar from unintentionally disengaging from the bouncer, including toward or onto the infant occupant while in use. That is, in the event an attempt is made to use the toy bar as a handle, embodiments of the present invention as described herein provide features for automatically disengaging the toy bar from its locked position, as well as automatically disengaging the toy bar from the bouncer, before the toy bar can be used as a lifting handle. In this regard, embodiments of the present invention provide an assembly and apparatus for preventing misuse of a toy bar as a handle, while also preventing the toy bar from unintentionally becoming separated from the bouncer.

Figure 1:
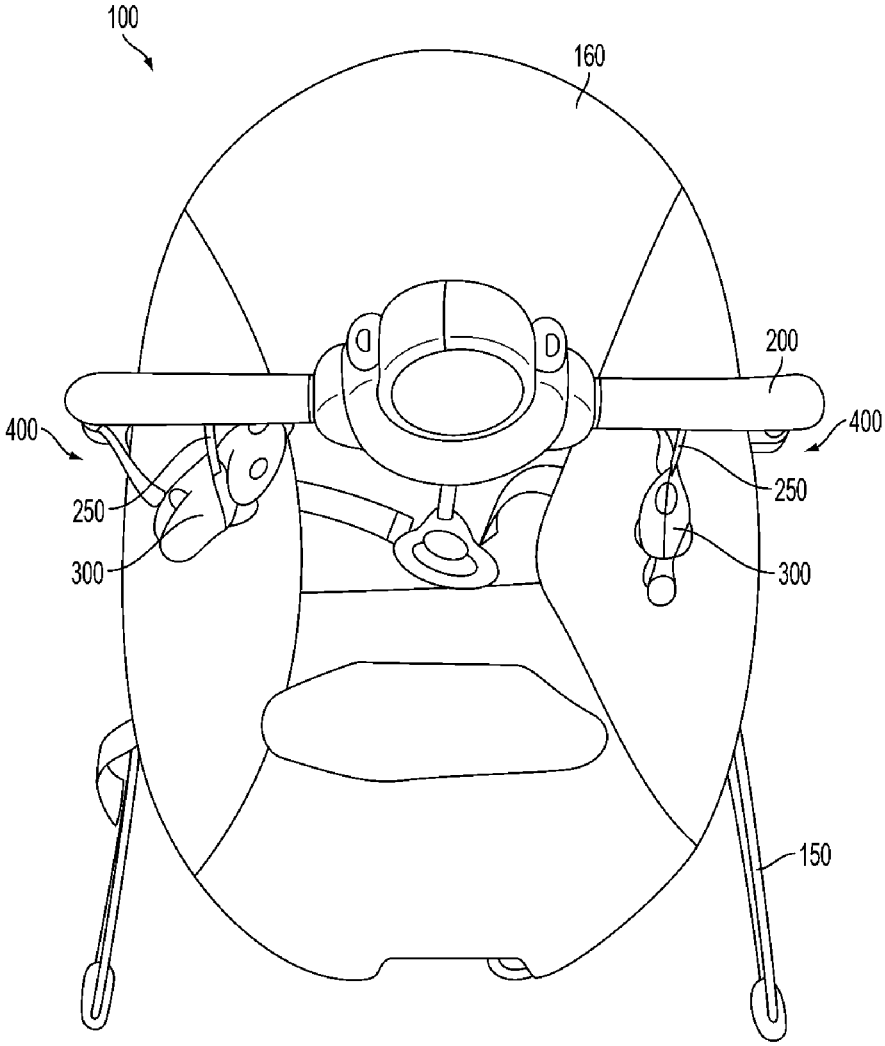
FIG. 1 is a perspective view of an infant seat assembly capable of implementing embodiments of the present invention.
Figure 2:
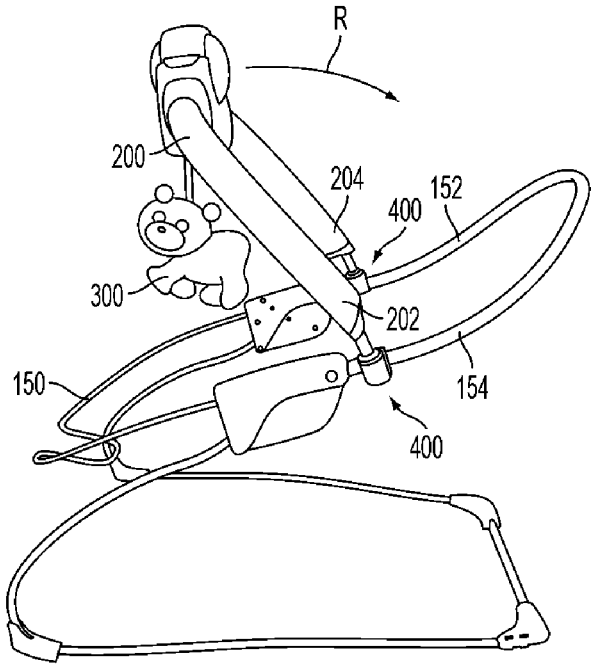
FIG. 2 is a perspective view of a seat frame of an infant seat assembly having a toy bar arrangement mounted thereto via a toy bar mounting assembly, according to one embodiment of the present invention, the toy bar arrangement being shown in a locked position.
Figure 3:
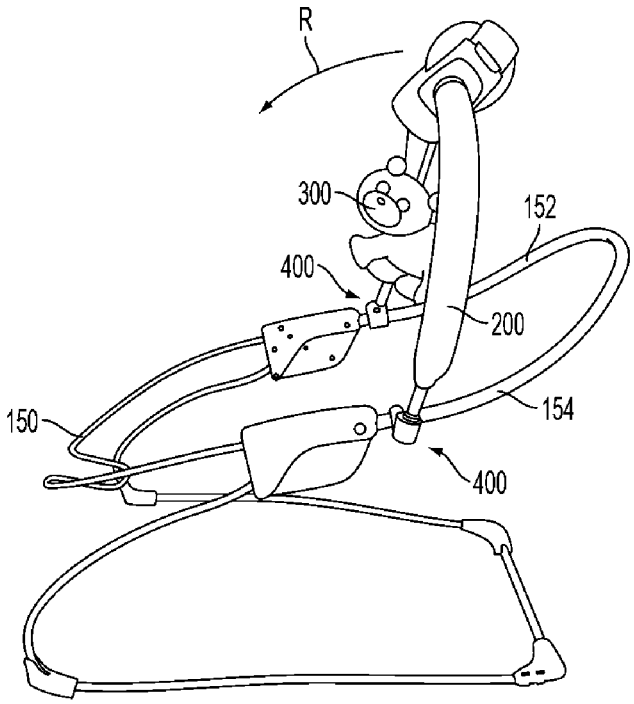
FIG. 3 is a perspective view of the seat frame and toy bar arrangement of FIG. 2, but with the toy bar arrangement shown rotated to an unlocked position.
Figure 4:
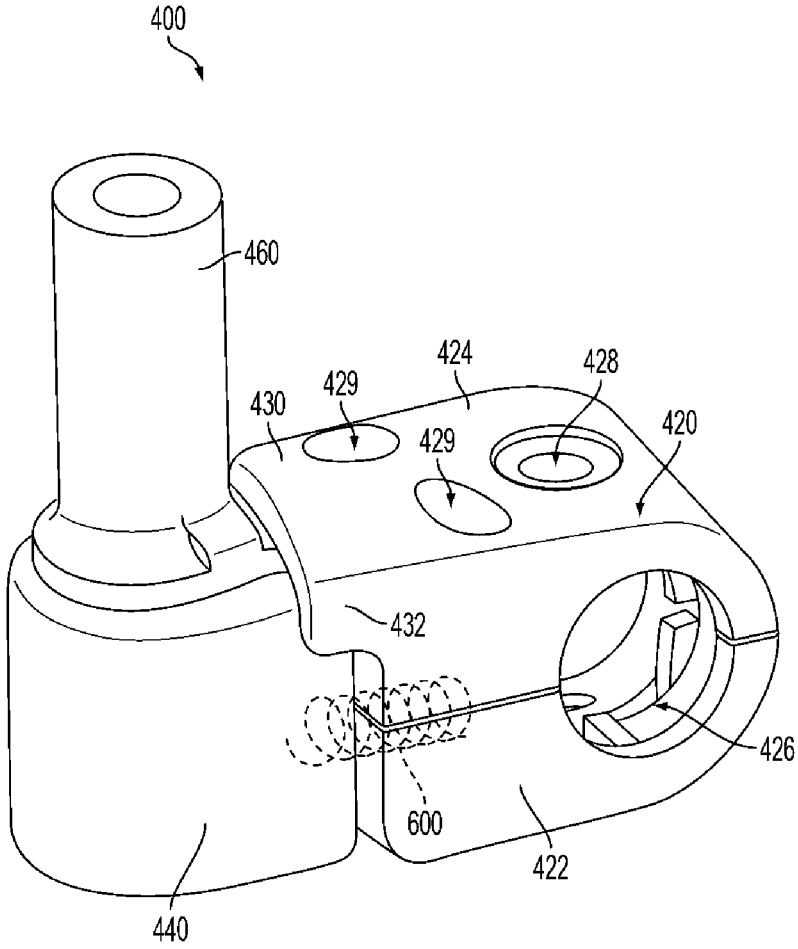
FIG. 4 is a perspective view of a toy bar mounting assembly, according to one embodiment of the present invention.
Figure 5:
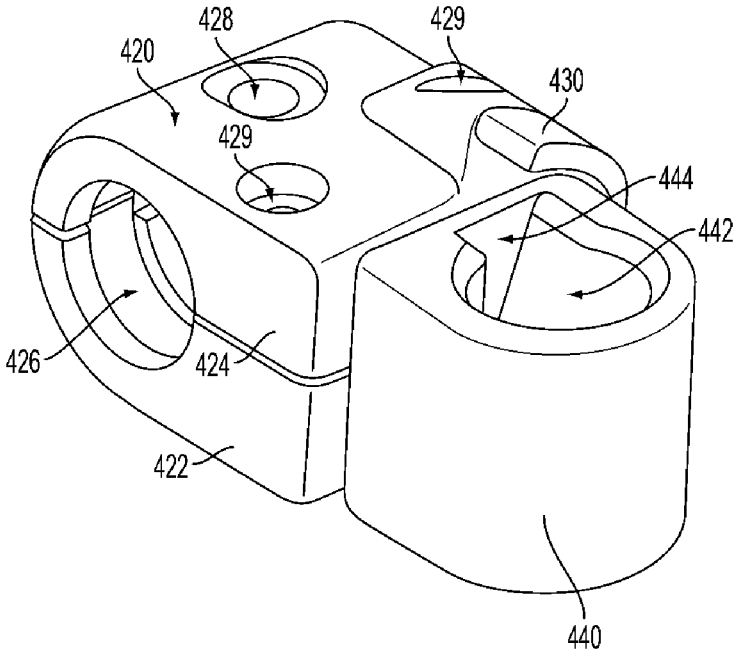
FIG. 5 is a perspective view of a mounting member and receptacle member of the toy bar mounting assembly of FIG. 4.
Figure 6:
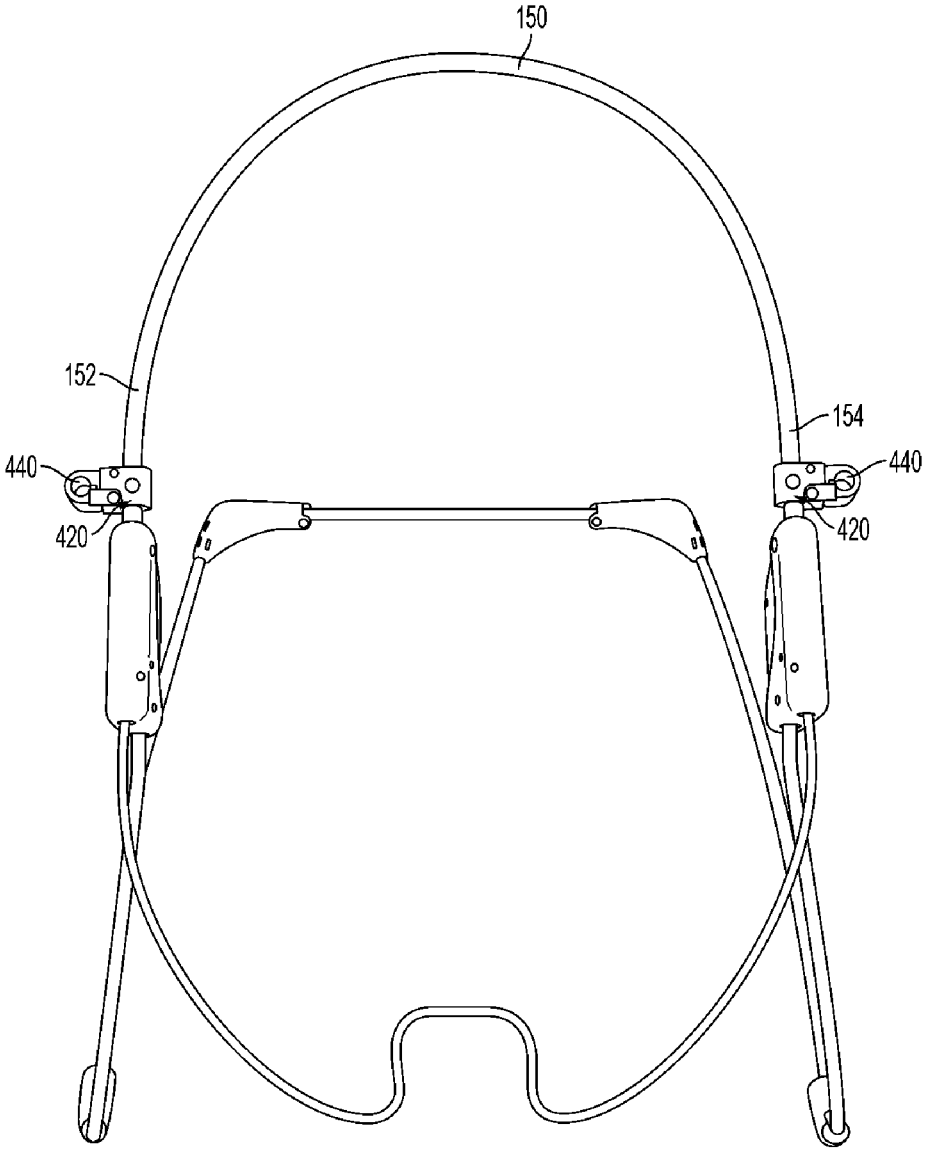
FIG. 6 is a perspective view of a seat frame of a infant seat assembly having a pair of toy bar mounting assemblies attached thereto, according to one embodiment of the present invention.

FIG. 1 illustrates an infant seat assembly 100 (e.g., a bouncer) with a toy bar arrangement 200 having hanging straps 250 for toys 300. A seat portion 160 for supporting the infant occupant may be removably attached to the seat frame 150 using suitable fastening mechanisms (not shown) such as, for example, straps having a buckle arrangement and/or hook and loop fasteners. As shown in FIGS. 2 and 3, the toy bar arrangement 200 may extend between two side portions 152, 154 of a seat frame 150 of the infant seat assembly 100 and is mounted onto the seat frame 150 using a plurality of toy bar mounting assemblies 400. The toy bar mounting assemblies 400 permit the toy bar arrangement 200 to rotate and follow an arcuate path of motion R between a locked (FIG. 2) and unlocked position (FIG. 3). As shown in FIG. 4, each toy bar mounting assembly 400 may include a mounting member 420, a receptacle member 440, and a mating member 460. The toy bar mounting assembly 400 may be constructed from any suitable material such as, for example, plastic, metal, or ceramic. Further, the individual components of the toy bar mounting assembly 400 may be constructed from the same or different materials.

As shown in FIGS. 4-10, the mounting member 420 may include first and second portions 422, 424 cooperating to define a channel 426 for receiving a portion (e.g., one of side portions 152, 154) of the seat frame 150 therebetween for fixedly mounting the mounting member 420 to the seat frame 150. The mounting member 420 is fixed or assembled to the seat frame 150 in a stationary manner. In some instances, the first and second portions 422, 424 may be discrete and separate pieces, which can be fixed to the seat frame 150 by appropriate fasteners, such as, for example, rivets 500, bolts or the like, received through fastener apertures 428 defined by the mounting member 420. In other instances, the first and second portions 422, 424 may be integrally formed as a single piece. For example, the first and second portions 422, 424 may be integrally hinged such that the first and second portions 422, 424 can be separated, but not entirely disconnected, to receive and enclose the side portion 152 or 154 of the seat frame 150 within the channel 426. The first and second portions 422, 424 may further define one or more closure apertures 429 in corresponding alignment for receiving fasteners, such as, for example, rivets 550, bolts or the like, so as to maintain enclosure of the side portion 152 or 154 of the seat frame 150 within the channel 426. The mounting member 420 may include a locking member 430 arranged to cooperate with other components of the toy bar mounting assembly 400 so as to provide the locking position for the toy bar arrangement 200, as further described herein. In some instances, the locking member 430 may be a wall member that extends from one of the first and second portions 422, 424 of the seat frame mounting member 420.

Figure 7:
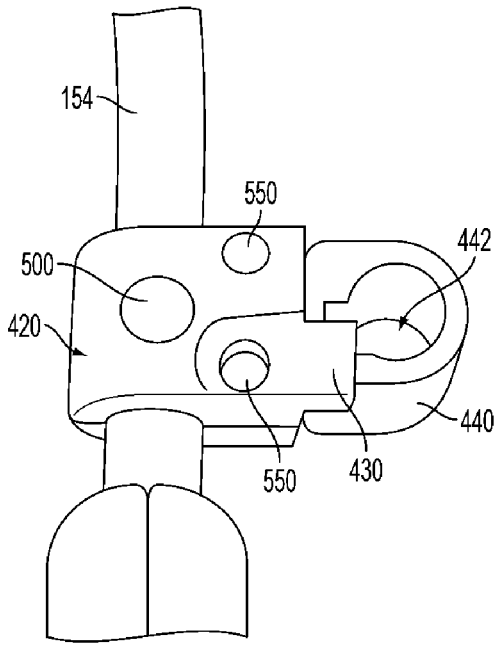
FIGS. 7 and 8 are various perspective views of a mounting member and receptacle member of a toy bar mounting assembly engaged with a seat frame of a infant seat assembly, according to one embodiment of the present invention.
Figure 8:
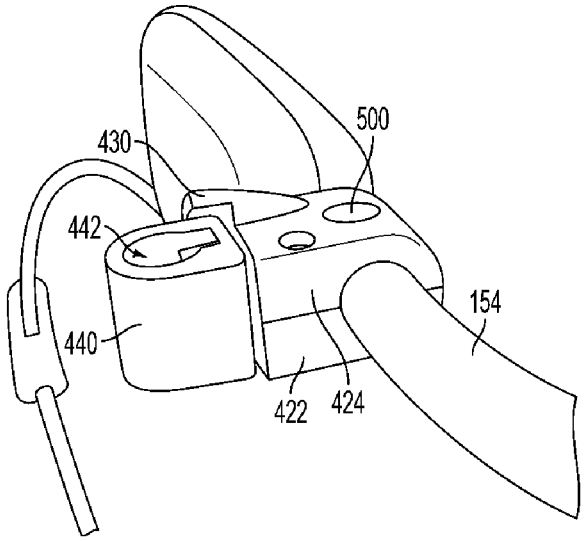
Figure 9:
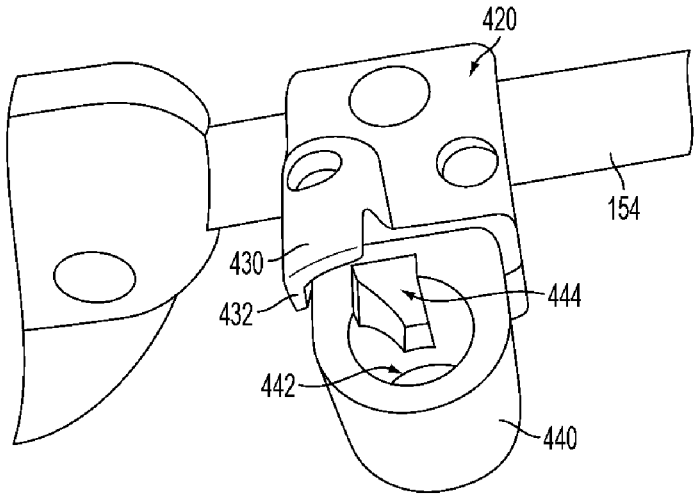
FIGS. 9 and 10 are perspective views of a receptacle member of a toy bar mounting assembly in a locked and unlocked position, respectively, according to one embodiment of the present invention.
Figure 10:
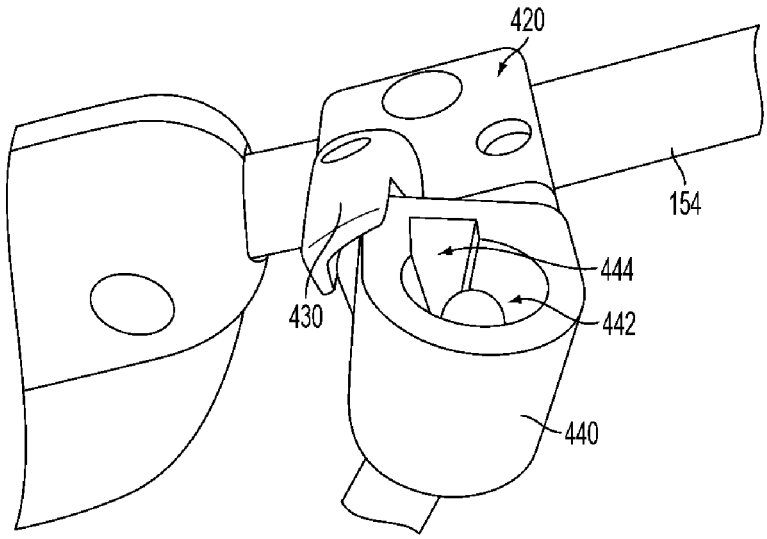

With continuing reference to FIGS. 4-10, the receptacle member 440 may be operably engaged with the mounting member 420 so as to be rotatable with respect thereto. As particularly shown in FIGS. 9 and 10, the receptacle member 440 may be rotatable about a substantially horizontal axis with respect to the mounting member 420, and between a locked position (FIG. 9) and an unlocked position (FIG. 10) in relation to the locking member 430 associated with the mounting member 420. The receptacle member 440 defines a cavity 442 for receiving the mating member 460. In some instances, the cavity 442 may extend entirely through the receptacle member 440. As shown in FIGS. 7 and 9, when the receptacle member 440 is in the locked position, the locking member 430 extends partially over the cavity 442. As shown in FIG. 10, when in the unlocked position, the receptacle member 440 is rotated such that the cavity 442 is clear of the locking member 430. According to some embodiments, the receptacle member 440 may comprise a keyway 444 which allows the mating member 460 to be inserted in only one orientation with respect to a key associated with the mating member 460.

As shown in FIG. 4, a biasing member 600 may be operably engaged between the mounting member 420 and the receptacle member 440 and configured to rotatably bias the receptacle member 440. In some instances, the receptacle member 440 may be normally biased toward the locked position. The biasing member 600 may comprise, for example, a torsion spring or other suitable mechanism for rotatably biasing the receptacle member 440. In some embodiments, the mounting member 420 and the receptacle member 440 may be rotatably engaged via a ratcheting device, spring lock or other suitable mechanism. As shown in FIGS. 4 and 9, a stop or detent portion 432 may be associated with the mounting member 420 to prevent further rotation of the receptacle member 440.

Figure 11:
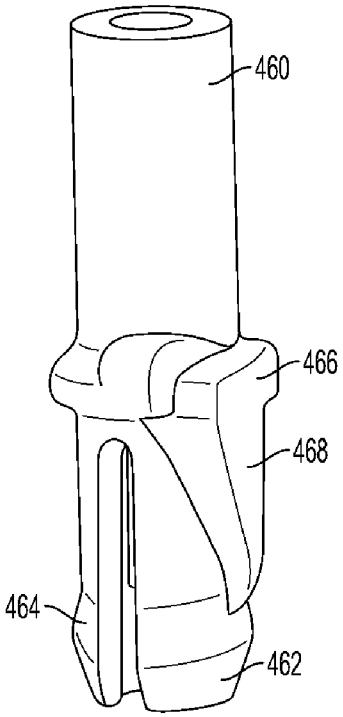
FIGS. 11 and 12 are perspective views of a mating member of a toy bar mounting assembly, according to one embodiment of the present invention.
Figure 12:
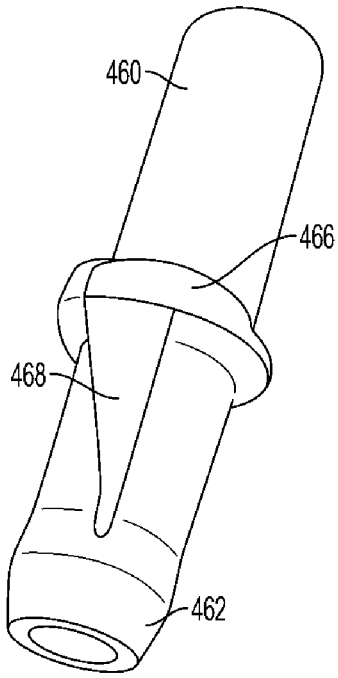

As shown in FIGS. 4, 11 and 12, the mating member 460 may be configured such that at least a portion thereof mates with or is otherwise inserted within the receptacle member 440 in a removable manner. Each mating member 460 may be attached, fixed, or otherwise engaged with an end 202 or 204 (FIG. 2) of the toy bar arrangement 200. When engaged, the mating member 460 can rotate in conjunction with the receptacle member 440 between the locked and unlocked positions. According to some embodiments, the mating member 460 may be in the general form of a post. In such instances, the mating member 460 may include a bifurcated portion having first and second flexible tab or cantilevered latch portions 462, 464 configured to releasably secure the mating member 460 within the cavity 442 of the receptacle member 440 via, for example, an interference fit. The mating member 460 may include a locking flange 466 configured to engage or otherwise interact with the locking member 430 associated with the mounting member 420 when in the locked position so as to prevent the mating member 460 from disengaging the receptacle member 440 in response to an axial force applied to the mating member 460 along a non-vertical axis (or along the axis of the mating member 460) or a rotational force applied to the mating member 460 toward the locked position.

Figure 13:
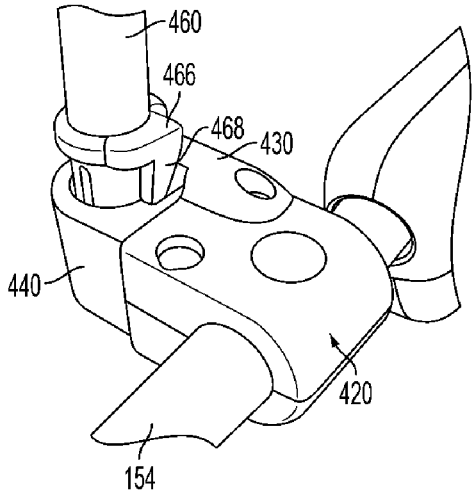
FIG. 13 is a perspective view of a toy bar mounting assembly engaged with a seat frame, according to one embodiment of the present invention, wherein a mating member is shown as partially inserted within a receptacle member.
Figure 14:
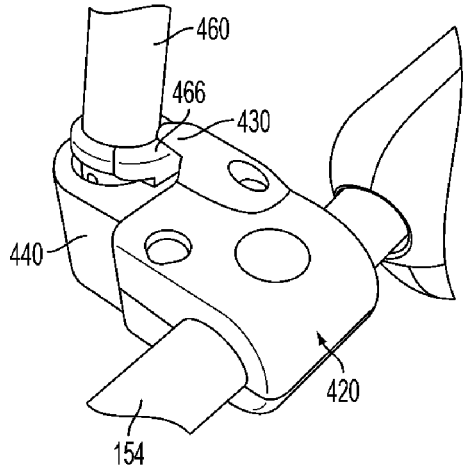
FIGS. 14 and 15 are perspective views of a toy bar mounting assembly engaged with a seat frame of an infant seat assembly, illustrating the toy bar mounting assembly in a locked and unlocked position, respectively.
Figure 15:
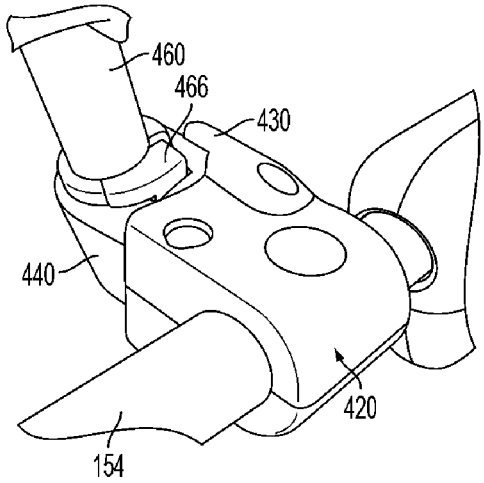

The mating member 460 may include a key 468 configured to be received within the keyway 444 associated with the receptacle member 440 so as to allow the mating member 460 to be inserted within the cavity 442 in only one orientation. In some instances, the key 468 may have a wedge-shaped profile and the keyway 444 is correspondingly configured to receive the key 468. In such instances, the wedge-shape profile of the key 468 is used to guide the mating member 460 into the cavity 442 of the receptacle member 440 by serving as a wedge which automatically causes the receptacle member 440 to rotate away from the locked position and permitting the mating member 460 to be seated into the receptacle member 440, as shown in FIG. 13. Once seated, the biasing member 600 allows the receptacle member 440 to rotate toward the locking member 430 which extends from the mounting member 420 and which creates the locked position and further helps to secure the toy bar arrangement 400 to the seat frame 150, preventing its unintentional release (i.e., with the toy bar arrangement 400 in a normal, engaged in-operation position with respect to the seat frame 150).

FIGS. 14, 16, 18 and 20 illustrate the toy bar mounting assembly 400 in a locked position, wherein the mating member 460 and the receptacle member 440 engaged therewith extend along a non-vertical axis A1 (see FIGS. 16 and 18). In the locked position, the locking flange 466 is configured to engage the locking member 430 so as to prevent the mating member 460 from disengaging the receptacle member 440 in response to an axial force applied to the mating member 460 along the non-vertical axis A1 and/or a rotational force applied to the mating member 460 toward the locked position. In this manner, the toy bar arrangement 200 may be prevented from its unintentional removal by an infant occupant interacting therewith (i.e., the toys 300). As shown in FIGS. 2 and 3, the toy bar arrangement 200 may be rotated toward the unlocked position such that the toy bar arrangement 200 may be removed from the seat frame 150 for storage or transportation. In this regard, once the receptacle member 440 and mating member 460 are rotated such that the locking flange 466 clears the locking member 430, the mating member 460 may be released and removed from the receptacle member 440 by the user.

As shown in FIGS. 15, 17, 19 and 21, when an upward or substantially vertical force is applied to the toy bar arrangement 200 (i.e., an attempt is made to lift the infant seat assembly 100 using the toy bar arrangement 200), the rotational (non-vertical) offset of the toy bar arrangement 200 in the locked position causes the toy bar arrangement 200 to rotate toward the unlocked position about the rotational centers associated with the receptacle members 440. In addition, the locking flange 466 of the mating member 460 interacts with the locking member 430 and causes the receptacle member 440 to rotate away from the lock position toward the unlocked position, thereby providing clearance of the locking flange 466 with respect to the locking member 430, which allows the mating member 460 to be removed from the receptacle member 440 in tandem with overcoming the cantilevered latch portions incorporated into the mating member 460 so as to release the toy bar arrangement 200. That is, the locking member 430 is configured to disengage the locking flange 466 in the unlocked position so as to allow the mating member 460 to be disengaged from the receptacle member 440 in response to an axial force applied to the mating member along a substantially vertical axis A2 (see FIGS. 17 and 19) and/or a rotational force applied to the mating member 460 toward the unlocked position. In this manner, the toy bar arrangement 200 may be prevented from supporting the seat frame 150 of the infant seat assembly 100 (i.e., being used as a handle).

Many modifications and other embodiments of the inventions set forth herein will come to mind to one skilled in the art to which these inventions pertain having the benefit of the teachings presented in the foregoing descriptions and the associated drawings. For example, throughout its path of motion, opportunities to provide stops which prevent or limit rotation of the toy bar arrangement 200 as well as guides and slots to enable desirable rotation can be identified such that normal assembly of the toy bar arrangement 200 with the seat frame 150 will implement such features to prevent inadvertent release. Furthermore, the disengagement of the toy bar arrangement 200 may be as a result of any one of several mechanisms, including ratcheting devices, spring locks or other mechanisms that allow the toy bar arrangement 200 to move from a locked position to an unlocked position as a direct result of a caretaker's attempt to lift the infant seat assembly 100 while using the toy bar arrangement 200 as a handle. In addition, the interaction between the locking flange 466 and the locking member 430 may be contained within a housing structure so as to reduce the possibility of pinching a caregiver or infant occupant. Such a housing structure may be generally funnel-shaped such that the mating member 460 can be inserted within the housing structure to engage the receptacle member 440. In some instances, the housing structure may be integrally formed as part of the mounting member 420. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A mounting assembly for mounting a toy bar arrangement to a frame of an infant seat assembly, the mounting assembly comprising:

a mounting member adapted to fixedly engage a frame of an infant seat assembly;

a receptacle member operably engaged with the mounting member and defining a cavity, the receptacle member being rotatable about a substantially horizontal axis with respect to the mounting member, and between a locked position and an unlocked position in relation to a locking member associated with the mounting member; and a mating member adapted to operably engage a toy bar arrangement and configured to be removably received within the cavity of the receptacle member so as to be rotatable in conjunction with the receptacle member between the locked and unlocked positions, the mating member and the receptacle member engaged therewith extending along a non-vertical axis in the locked position, the mating member having a locking flange associated therewith, the locking flange being configured to engage the locking member in the locked position so as to prevent the mating member from disengaging the receptacle member in response to one of an axial force applied to the mating member along the non-vertical axis and a rotational force applied to the mating member toward the locked position, the mating member being configured to rotate to the unlocked position, and the locking member being configured to disengage the locking flange in the unlocked position so as to allow the mating member to be disengaged from the receptacle member, in response to at least one of an axial force applied to the mating member along a vertical axis and a rotational force applied to the mating member toward the unlocked position, so as to prevent the toy bar arrangement from supporting the frame of the seat assembly.

2. A mounting assembly according to claim 1 further comprising a biasing member operably engaged between the mounting member and the receptacle member and configured to rotatably bias the receptacle member.

3. A mounting assembly according to claim 2 wherein the receptacle member is normally biased toward the locked position.

4. A mounting assembly according to claim 1 wherein the mounting member comprises first and second portions configured to cooperate to define a channel for receiving the frame therebetween for fixedly mounting the mounting member to the frame.

5. A mounting assembly according to claim 1 wherein the receptacle member defines a keyway configured to receive a key associated with the mating member.

6. A mounting assembly according to claim 5 wherein the key has a wedge-shaped profile and the keyway is correspondingly configured to receive the key.

7. An infant seat assembly, comprising:

a frame having first and second side portions;

a toy bar arrangement extending between the first and second side portions and having opposing ends;

a pair of mounting members, each mounting member being fixedly engaged with one of the side portions of the frame;

a pair of receptacle members, each receptacle member being operably engaged with a respective mounting member and defining a cavity, and each receptacle member being rotatable about a substantially horizontal axis with respect to the respective mounting member, and between a locked position and an unlocked position in relation to a locking member associated with at least one of the mounting members; and a pair of mating members, each mating member being operably engaged with a respective end of the toy bar arrangement and being configured to be removably received within the cavity of the respective receptacle member so as to be rotatable in conjunction with the respective receptacle member between the locked and unlocked positions, each mating member and the receptacle member correspondingly engaged therewith extending along a non-vertical axis in the locked position, the mating member received by the receptacle member associated with the at least one of the mounting members having the locking member associated therewith further including a locking flange associated therewith, the locking flange being configured to engage the locking member in the locked position so as to prevent the mating member from disengaging the receptacle member in response to one of an axial force applied to the mating member via the toy bar arrangement along the non-vertical axis and a rotational force applied to the mating member via the toy bar arrangement toward the locked position, the mating member being configured to rotate to the unlocked position, and the locking member being configured to disengage the locking flange in the unlocked position so as to allow the mating member to be disengaged from the receptacle member, in response to at least one of an axial force applied to the mating member via the toy bar arrangement along a vertical axis and a rotational force applied to the mating member via the toy bar arrangement toward the unlocked position, so as to prevent the toy bar arrangement from supporting the frame of the seat assembly.

8. An infant seat assembly according to claim 7 further comprising a biasing member operably engaged between the mounting member and the receptacle member and configured to rotatably bias the receptacle member.

9. An infant seat assembly according to claim 8 wherein the receptacle member is normally biased toward the locked position.

10. An infant seat assembly according to claim 7 wherein the mounting member comprises first and second portions configured to cooperate to define a channel for receiving the frame therebetween for fixedly mounting the mounting member to the frame.

11. An infant seat assembly according to claim 7 wherein the receptacle member defines a keyway configured to receive a key associated with the mating member.

12. An infant seat assembly according to claim 11 wherein the key has a wedge-shaped profile and the keyway is configured to receive the key.

* * * * *